US011105509B2

(12) United States Patent
Obrecht

(10) Patent No.: US 11,105,509 B2
(45) Date of Patent: Aug. 31, 2021

(54) FLAME MONITOR

(71) Applicant: Siemens Aktiengesellschaft, Munich (DE)

(72) Inventor: Klaus Obrecht, Baden-Baden (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 52 days.

(21) Appl. No.: 16/701,466

(22) Filed: Dec. 3, 2019

(65) Prior Publication Data

US 2020/0182463 A1 Jun. 11, 2020

(51) Int. Cl.

*F23N 5/12* (2006.01)
*F23N 5/08* (2006.01)
*F23N 5/24* (2006.01)

(52) U.S. Cl.

CPC ..... *F23N 5/123* (2013.01); *F23N 5/082* (2013.01); *F23N 5/242* (2013.01); *F23N 2227/16* (2020.01); *F23N 2229/06* (2020.01); *F23N 2229/14* (2020.01)

(58) Field of Classification Search

CPC .... F23D 14/74; F23D 14/725; F23D 2209/20; F23N 2229/00; F23N 5/242; F23N 5/265; F23N 1/002; F23N 1/005; F23N 2223/08; F23N 2223/38; F23N 2225/04; F23N 2225/16; F23N 2227/02; F23N 2227/08; F23N 2227/28; F23N 2229/02; F23N 2229/04; F23N 2229/14; F23N 2229/16; F23N 2237/02; F23N 2237/06;

(Continued)

(56) References Cited

U.S. PATENT DOCUMENTS 2,579,884 A 12/1951 Thomson et al. ..... 307/653
6,501,383 B1 12/2002 Haupenthal ..... 340/578
9,453,640 B2 9/2016 Krichtafovitch et al.

(Continued)

FOREIGN PATENT DOCUMENTS

CN 101501473 A 8/2009 ..... F23N 5/00
CN 102022735 A 4/2011 ..... F23D 14/74

(Continued)

OTHER PUBLICATIONS

Chinese Office Action, Application No. 201911241182.0, 10 pages.

*Primary Examiner* — Jason Lau
(74) *Attorney, Agent, or Firm* — Slayden Grubert Beard PLLC

(57) ABSTRACT

Various embodiments include a control system comprising: an ionization electrode; a flame sensor; a first signal conditioning circuit for the ionization electrode; a second signal conditioning circuit for the flame sensor; an output unit; and a processor. The processor: receives a first and a second ionization signal indicative of ionization currents from the first signal conditioning circuit; receives a first and a second flame signal indicative of radiations originating from a flame via the second signal conditioning circuit; produces a derived ionization signal as a function of the first and the second ionization signals; produces a derived flame signal as a function of the first and the second flame signals; determines if a flame lift-off condition exists based on the derived ionization signal and the derived flame signal; and if a flame lift-off condition exists, produces a safety signal and transmits the safety signal to the output unit.

15 Claims, 4 Drawing Sheets

(58) Field of Classification Search
CPC ..... F23N 2239/04; F23N 2241/08; F23N 2900/00; F23N 5/08; F23N 5/082
See application file for complete search history.

(56) References Cited

U.S. PATENT DOCUMENTS

| | | | | |
|---|---|---|---|---|
| 9,625,311 | B2 | 4/2017 | Mori | |
| 9,822,708 | B2 | 11/2017 | Burke et al. | |
| 10,161,682 | B2 | 12/2018 | Gallagher et al. | |
| 2010/0157285 | A1 | 6/2010 | Hangauer et al. | 356/51 |
| 2018/0202653 | A1 | 7/2018 | Karkow | |
| 2018/0266683 | A1 | 9/2018 | Nishiyama et al. | |

FOREIGN PATENT DOCUMENTS

| | | | | |
|---|---|---|---|---|
| CN | 104199117 | A | 12/2014 | B01V 8/10 |
| CN | 104350332 | A | 2/2015 | F23D 14/46 |
| CN | 106196159 | A | 12/2016 | F23M 11/04 |
| CN | 106414954 | A | 2/2017 | F02C 7/264 |
| CN | 106796087 | A | 5/2017 | F27D 21/00 |
| CN | 206292939 | U | 6/2017 | G01J 3/427 |
| CN | 107923613 | A | 4/2018 | F23C 5/06 |
| CN | 108626742 | A | 10/2018 | F23N 5/00 |
| DE | 1 526 211 | B1 | 5/1970 | F23N 5/02 |
| DE | 195 02 901 | C1 | 3/1996 | F23D 14/60 |
| DE | 19502910 | C1 | 3/1996 | F23D 14/60 |
| EP | 0 942 232 | B1 | 9/2005 | F02C 9/00 |
| EP | 3 339 736 | A1 | 6/2018 | F23N 5/08 |
| JP | S62-91722 | A | 4/1987 | F23C 6/04 |
| JP | 2001023055 | A | 1/2001 | F23M 11/04 |
| RU | 2034203 | C1 | 4/1995 | F23N 5/12 |
| RU | 2072480 | C1 | 1/1997 | F23N 5/08 |
| UA | 15224 | U | 6/2006 | C22B 1/00 |

FLAME MONITOR

CROSS-REFERENCE TO RELATED APPLICATIONS

This application claims priority to EP Application No. 18210617.9 filed Dec. 6, 2018, the contents of which are hereby incorporated by reference in their entirety.

TECHNICAL FIELD

The present disclosure relates to monitoring flames in a combustion appliance. Various embodiments include the use of electrical and optical principles to detect of flame lift-off inside a burner.

BACKGROUND

Combustion appliances such as gas burners or oil burners frequently employ exhaust gas recirculation in an attempt to reduce emissions of oxides of nitrogen. Exhaust gas recirculation may, however, result in flame lift-off. Flame lift-off is an unwanted condition. Flame lift-off can entail a safety lockout of a combustion appliance. It is thus desirable to monitor flame lift-off inside a combustion appliance.

A European patent application EP3339736A1 describes flame detection for combustion appliances. The arrangement harnesses a photodiode 1 connected to a differential amplifier 2 to detect a flame. An amount of light of at least 1.1 Lux is received by the photodiode 1. An operational amplifier 2 such as a low-noise differential amplifier produces an electric current in response to a signal originating from the photodiode 1. EP3339736A1 describes a photodiode 1 having a first spectral sensitivity $\lambda_{10\%,1}$ at 900 nanometers optical wavelength and a second spectral sensitivity $\lambda_{10\%,2}$ at 600 nanometers optical wavelength. The photodiode 1 may, in particular, be a silicon diode.

European patent EP0942232B1 describes a flame sensor with dynamic sensitivity adjustment. The disclosure of EP0942232B1 focuses on flame detection in gas turbines. A circuit with two amplifiers U1A and U1B is employed to dynamically adjust sensitivity. A photodiode D4 made of silicon carbide (SiC) connects to the non-inverting input of amplifier U1A. The gain of amplifier U1A is controlled via a switch 01. If the switch 01 becomes conducting, it will shunt a resistor R4. Since R4 is part of the feedback loop that controls the gain of amplifier U1A, it also controls the sensitivity of the circuit. The amplifier U1B in conjunction with a transistor 02 acts to convert the output voltage of U1A into an electric current. The circuit employs a silicon carbide (SiC) diode that detects (ultraviolet) light at optical wavelengths such as 310 nanometers.

German patent DE19502901C1 relates to control of a gas burner. DE19502901C1 describes a gas burner 1 with an ionization electrode 6. FIG. 3 shows a plot of observed fluctuations of a signal emanating from the electrode 6 for a range of lambda values λ. Those fluctuations of signals from the ionization electrode 6 increase linearly between λ=1.1 and λ=1.6. DE19502901C1 describes a circuit made up of a voltage divider 9, various filters 10, 11, 13, and a rectifier 12. The circuit 9-13 produces a measure of lambda A as a function of the fluctuations of an ionization signal at its input.

SUMMARY

The present disclosure teaches a monitor to reliably detect flame lift-off inside a burner. The instant disclosure focuses on a circuit for use in combustion appliances for fossil fuels. For example, some embodiments of the teachings herein include a control system comprising an ionization electrode (4), a first flame sensor (12), a first signal conditioning circuit (15) in operative communication with the ionization electrode (4), a second signal conditioning circuit (16) in operative communication with the first flame sensor (12), an output unit (18), a processor (14) in operative communication with the first and with the second signal conditioning circuits (15, 16) and with the output unit (18), the processor (14) being configured to: receive first and second ionization signals indicative of ionization currents via the first signal conditioning circuit (15) from the ionization electrode (4), the second ionization signal being received after the first ionization signal; receive first and second flame signals indicative of radiations originating from a flame (1*a*-1*c*) via the second signal conditioning circuit (16) from the first flame sensor (12), the second flame signal being received after the first flame signal; produce a derived ionization signal as a function of the first and the second ionization signals; produce a derived flame signal as a function of the first and the second flame signals; determine if a flame lift-off condition exists based on the derived ionization signal and based on the derived flame signal; and if a flame lift-off condition exists, produce a safety signal and transmit the safety signal to the output unit (18).

In some embodiments, the processor (14) is configured to: produce the derived ionization signal as a difference between the first ionization signal and the second ionization signal; and produce the derived flame signal as a difference between the first flame signal and the second flame signal.

In some embodiments, the processor (14) is configured to: produce the derived ionization signal as an absolute value of a difference between the first ionization signal and the second ionization signal; and produce the derived flame signal as an absolute value of a difference between the first flame signal and the second flame signal.

In some embodiments, the processor (14) is configured to: compare the derived ionization signal to a first predetermined threshold to produce a first indication of flame lift-off; compare the derived flame signal to a second predetermined threshold to produce a second indication of flame lift-off; and determine if a flame lift-off condition exists as a function of the first and the second indications of flame lift-off.

In some embodiments, the processor (14) is configured to determine that a flame lift-off condition exists if the first indication of flame lift-off exceeds the first predetermined threshold, or if the second indication of flame lift-off exceeds the second predetermined threshold.

In some embodiments, the processor (14) is configured to determine that a flame lift-off condition exists if the first indication of flame lift-off exceeds the first predetermined threshold, and if the second indication of flame lift-off exceeds the second predetermined threshold.

In some embodiments, the processor (14) is configured to: compare the second ionization signal to the first ionization signal; compare the second flame signal to the first flame signal; and determine that a flame lift-off condition exists if the second ionization signal is less than half the first ionization signal, or if the second flame signal is less than ninety percent of the first flame signal.

In some embodiments, the processor (14) is configured to: compare the second ionization signal to the first ionization signal; compare the second flame signal to the first flame signal; and determine that a flame lift-off condition exists if the second ionization signal is less than half the first ionization signal, and if the second flame signal is less than ninety percent of the first flame signal.

In some embodiments, the output unit (18) comprises a shut-off valve; and the shut-off valve (18) is configured to close in response to the output unit (18) receiving the safety signal.

In some embodiments, the output unit (18) comprises a display; the processor (14), in case of a flame lift-off condition, is configured to produce an alarm message and to transmit the alarm message to the display (18); and the display (18) is configured to show the received alarm message.

In some embodiments, the second ionization signal is received less than one thousand milliseconds after the first ionization signal; and the second flame signal is received less than one thousand milliseconds after the first flame signal.

In some embodiments, there is a second flame sensor (13), a third signal conditioning circuit (17) in operative communication with the second flame sensor (13), the processor (14) being in operative communication with the third signal conditioning circuit (17), the processor (14) being configured to: receive from the second flame sensor (13) via the third signal conditioning circuit (17) a third flame signal at a first point in time and a fourth flame signal at a second point in time, the third and the fourth flame signals being indicative of radiations originating from a flame (1*a*-1*c*), the fourth flame signal being received after the third flame signal; determine an oscillation frequency by sampling the third flame signal at the first point in time and the fourth flame signal at the second point in time; and determine if a flame lift-off condition exists based on the derived ionization signal and based on the derived flame signal and based on the oscillation frequency.

In some embodiments, the first flame sensor (12) comprises an ultraviolet light sensor, the first flame sensor (12) being configured to produce the first flame signal in response to receiving a first amount of ultraviolet light and being configured to produce the second flame signal in response to receiving a second amount of ultraviolet light; and ultraviolet light has an optical wavelength below four hundred nanometers.

In some embodiments, the second flame sensor (13) comprises an infrared light sensor, the second flame sensor (13) being configured to produce the third flame signal in response to receiving a first amount of infrared light and being configured to produce the fourth flame signal in response to receiving a second amount of infrared light; and infrared light has an optical wavelength above eight hundred nanometers.

As another example, some embodiments include a combustion appliance comprising a feed conduit (3), a combustion chamber (2) and a nozzle (7), the nozzle (7) affording fluid communication between the feed conduit (3) and the combustion chamber (2), the nozzle (7) having an injection orifice pointing toward the combustion chamber (2), the combustion appliance further comprising a control system as described above, wherein the ionization electrode (4) has a far end and has a tip (5) disposed at the far end of the ionization electrode (4); wherein the tip (5) is arranged inside the combustion chamber (2); and wherein a smallest distance among all distances between the tip (5) and the injection orifice is less than fifty millimeters.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

The instant disclosure teaches the use of technically redundant sensors to reliably detect flame lift-off inside a burner. Sensors can be employed such as:

an ionization electrode, an ultraviolet light sensor, and/or an infrared light sensor.

Ionization electrodes are commonly employed to estimate parameters such as gas-to-air ratios and/or to detect flames within combustion appliances. An ultraviolet light sensor can be employed to monitor ultraviolet light emitted from a root region of a flame. An infrared light sensor can be employed to observe fluctuations in intensity of infrared radiation from a flame. A synergistic approach using signals from various sensors and relying on various measurement principles affords a robust detection of flame lift-off.

The instant disclosure describes a control system that harnesses canonical sensor technology and harnesses canonical measurement principles.

The instant disclosure describes a reliable flame monitor wherein configuration and/or tuning of the control system is accomplished without replacing installed sensors and/or without (drastically) modifying the hardware setup of a combustion appliance.

The instant disclosure describes a flame monitor that reduces false positive indications of flame lift-off. That is, false alarms are inhibited.

The present disclosure describes a flame monitor that reduces false negative indications of flame lift-off. That is, a flame lift-off condition that is real shall be detected as such.

The instant disclosure describes a control system that takes appropriate action in the event of a flame lift-off condition. The control system shall, in particular, ensure that a combustion appliance is safely shut down albeit the flame lift-off condition.

The instant disclosure describes a control system that promptly responds to a flame lift-off condition.

The present disclosure describes an ionization electrode inside a combustion chamber such that the arrangement affords reliable detection of a flame lift-off condition.

Figure 1:
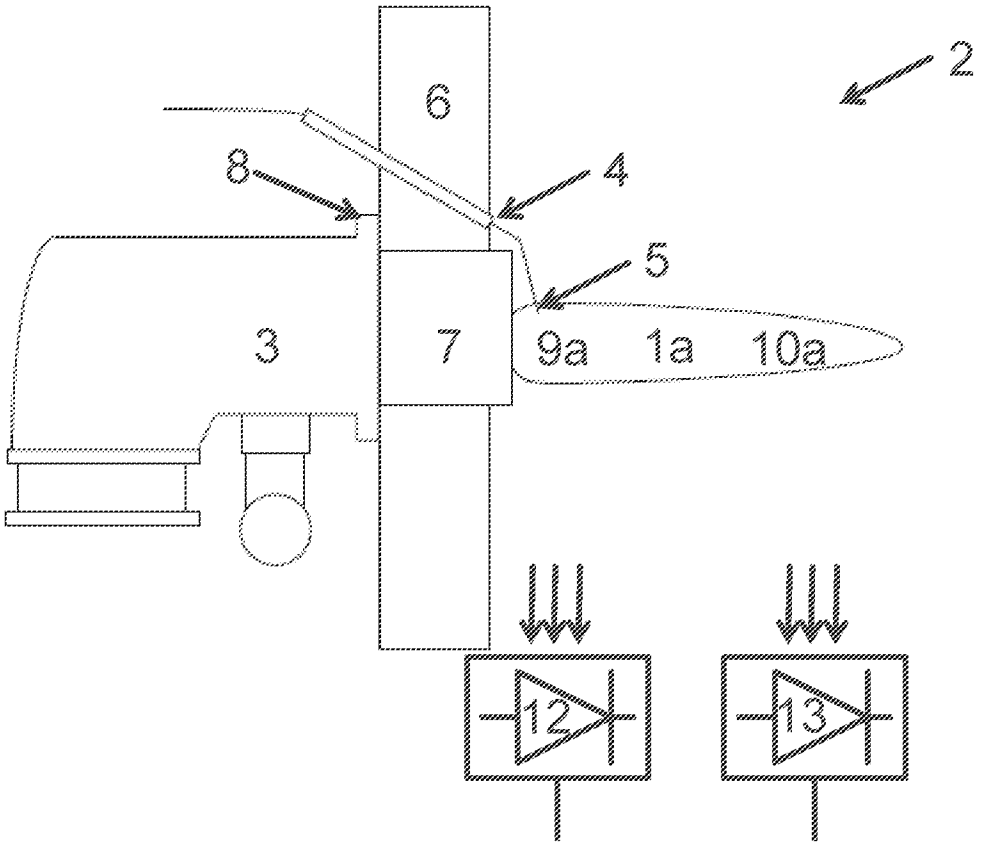
FIG. 1 schematically depicts a flame inside a combustion appliance at a low rate of combustion.

FIG. 1 shows a flame 1*a* inside a combustion chamber 2. A feed conduit 3 directs a combustible fluid such as oil or gas toward the combustion chamber 2. It is envisaged that a combustible gas such as methane, ethane, propane or hydrogen or a mixture thereof is conveyed via the feed conduit 3. In an embodiment, the combustible fluid is a mixture of a combustible gas and air. The combustion chamber 2 and the conduit 3 are typically part of a combustion appliance. The combustion appliance can, by way of non-limiting examples, comprise a gas burner.

The arrangement comprises an ionization electrode 4 with a tip 5. The ionization electrode 4 is arranged such that its tip 5 reaches inside the flame 1*a*. As shown on FIG. 1, the ionization electrode 4 can be mounted to a frame 6 such as a support disc. The frame 6 aligns the ionization electrode 4 such that its tip 5 will interact with the flame 1*a*.

The tip 5 of the ionization electrode 4 may comprise a portion made of an alloy of iron, of aluminum, and of chrome. The alloy may also comprise copper and nickel. Suitable alloys are marketed under the brand Kanthal®. It is envisaged that the tip 5 of the ionization electrode 4 withstands temperatures above 1173 Kelvin, e.g. above 1300 Kelvin, or above 1500 Kelvin. Higher values of temperature withstand confer advantages in terms of durability. Where elevated levels of temperature withstand are required, the tip 5 of the ionization electrode can comprise a portion made of silicon carbide. Suitable materials are marketed under the brand Globar®.

The feed conduit 3 may be tubular and provide a nozzle 7 having an injection orifice at its exit. A direction of fluid flow is defined by the nozzle 7. The combustible fluid is conveyed through the feed conduit 3. The combustible fluid is injected into the combustion chamber 2 at the injection orifice. The injection orifice may have a circular cross-section. This circular cross-section is perpendicular to the direction of fluid flow through the nozzle 7. In some embodiments, the cross-section of the injection orifice is quadratic and/or polygonal. In some embodiments, the nozzle 7 provides slots to reduce acoustic emissions.

FIG. 1 also shows that the frame 6 also envelopes the nozzle 7. That is, the ionization electrode 4 and the nozzle 7 are both mounted to and/or fitted to the frame 6. A flange 8 can be employed to secure the frame 6 relative to the feed conduit 3. In some embodiments, the flange 8 is employed to mount the frame 6 to the feed conduit 8.

The tip 5 of the ionization electrode 4 may be arranged in close proximity to the injection orifice. An arrangement of the tip 5 in close proximity to the injection orifice yields precise indications of flame lift-off. In some embodiments, the distance between the tip 5 and the point on the injection orifice closest to the tip 5 is less than 50 millimeters. Larger burners may require larger distances between the tip 5 and the point on the injection orifice closest to the tip 5. The distance between the tip 5 and the point on the injection orifice closest to the tip 5 may be less than 20 millimeters or even less than 10 millimeters.

In addition to the ionization electrode 4, the flame 1*a* is also monitored via at least one sensor 12, 13. In some embodiments, the arrangement comprises two sensors 12 and 13 that monitor the flame 1*a*. In some embodiments, at least one sensor 12, 13 is a light sensor. It is also envisaged that the two sensors 12 and 13 are both light sensors.

The first sensor 12 can, by way of non-limiting example, be a photodiode such as a silicon carbide diode or a cadmium sulfide device. In some embodiments, the first sensor 12 is a photomultiplier tube. In some embodiments, the first sensor 12 has a spectral sensitivity $\lambda_{10\%}$ that enables detection of ultraviolet light with optical wavelengths below 400 nanometers. The first sensor 12 may, in particular, detect light at an optical wavelength of 310 nanometers. The first light sensor 12 may also afford the detection of visible light with wavelengths between 500 nanometers and 600 nanometers and/or with wavelengths between 400 nanometers and 700 nanometers and/or with wavelengths between 500 nanometers and 800 nanometers.

In order for the first sensor 12 to receive light from the flame 1*a*, a focusing member can be interposed in the optical path. That is, the focusing member is interposed between the first sensor 12 and the flame 1*a*. In some embodiments, the focusing member is a lens such as a condenser. The lens and/or the condenser can, in particular, filter out certain wavelengths. The spectral sensitivity of the arrangement may thus improve. It is also envisaged that the focusing member is a diaphragm. The lens and/or the condenser and/or the diaphragm can also afford (limited) protection from soot.

The second sensor 13 can, by way of non-limiting example, be a photodiode such as a silicon (Si) photodiode or a germanium (Ge) photodiode or an indium gallium arsenide (InGaAs) photodiode. It is also envisaged that the second sensor 13 is a photomultiplier tube. In some embodiments, the second sensor 13 has a spectral sensitivity $\lambda_{10\%}$ that enables detection of infrared light with optical wavelengths above 700 nanometers, preferably above 800 nanometers. The second sensor 13 may, in particular, detect light at an optical wavelength of 900 nanometers. The second light sensor 13 may also afford the detection of visible light with wavelengths between 500 nanometers and 600 nanometers and/or with wavelengths between 500 nanometers and 800 nanometers and/or with wavelengths between 600 nanometers and 800 nanometers.

In order for the second sensor 13 to receive light from the flame 1*a*, a focusing member can be interposed in the optical path. That is, the focusing member is interposed between the second sensor 13 and the flame 1*a*. In some embodiments, the focusing member is a lens such as a condenser. The lens and/or the condenser can, in particular, filter out certain wavelengths. The spectral sensitivity of the arrangement may thus improve. It is also envisaged that the focusing member is a diaphragm. The lens and/or the condenser and/or the diaphragm can also afford (limited) protection from soot.

FIG. 1 illustrates a flame 1*a* inside a combustion chamber 2 at a low rate of combustion. The flame 1*a* as shown on FIG. 1 can, by way of non-limiting example, correspond to a rate of combustion that is between 10% and 20% of the rated power of a combustion appliance.

Figure 2:
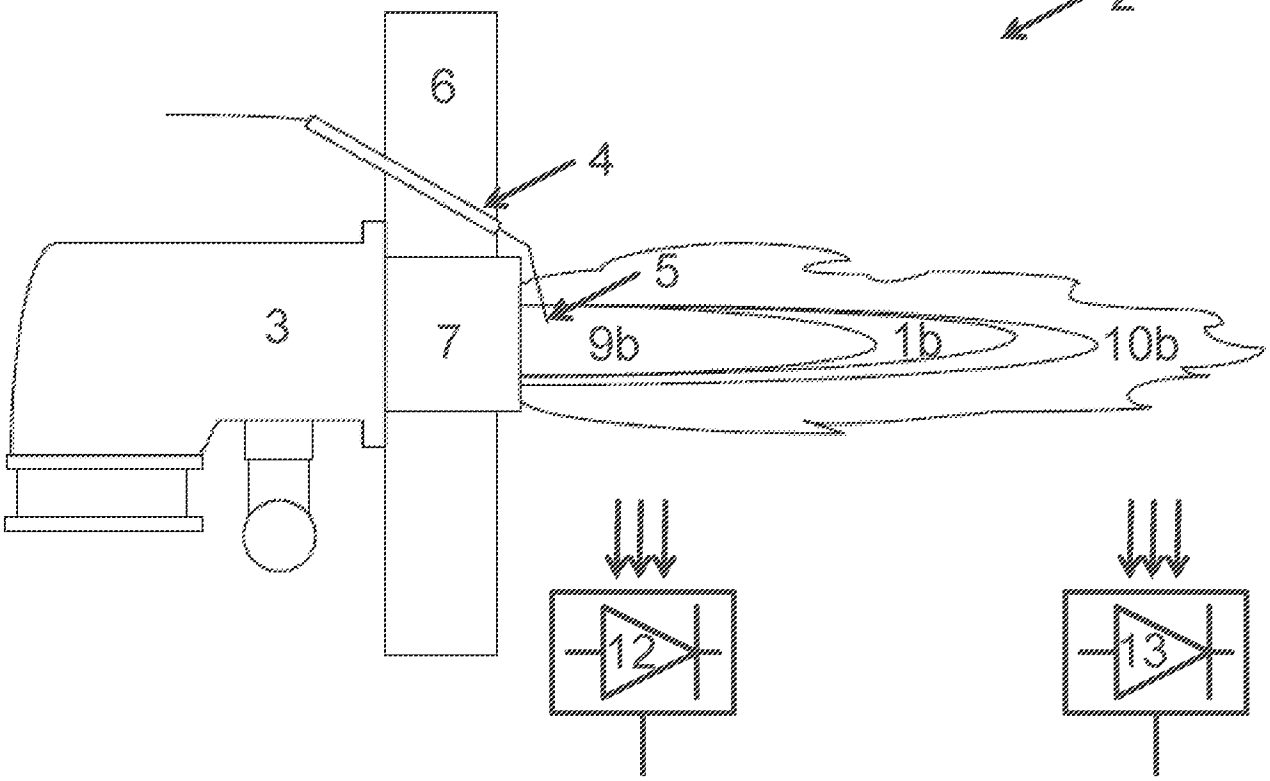
FIG. 2 schematically depicts a flame inside a combustion appliance at an elevated rate of combustion.

FIG. 2 illustrates a flame 1*b* inside a combustion chamber 2 at an elevated rate of combustion. The flame 1*b* as shown on FIG. 2 can, by way of non-limiting example, correspond to a rate of combustion that is between 70% and 100% of the rated power of a combustion appliance. The flame 1*b* at an elevated rate of combustion is larger in size compared to the flame 1*b* at a low rate of combustion. Also, the shape of the flame 1*b* at an elevated rate is ragged whilst the shape of the flame 1*a* at a low rate is regular. Different regions can be distinguished for each of the flames 1*a*, 1*b*. A root region 9*a*, 9*b* typically starts close to the injection orifice and covers approximately one third of the entire flame 1*a*, 1*b*. The root region largely emits radiation in the ultraviolet domain with optical wavelengths below 400 nanometers.

Infrared radiation with optical wavelengths exceeding 800 nanometers is predominantly emitted in the tail regions 10*a*, 10*b* of the flames 1*a*, 1*b*. The tail regions 10*a*, 10*b* are further away from the injection orifice than the root regions 9*a*, 9*b*. The tail regions 10*a*, 10*b* cover approximately two thirds of the flames 1*a*, 1*b*.

In some embodiments, the sensor 12 is arranged to monitor the root regions 9*a*, 9*b* of the flames 1*a*, 1*b*. The first sensor 12 can be employed to monitor ultraviolet radiation originating from the root regions 9*a*, 9*b* of the flames 1*a*, 1*b*. In some embodiments, the second sensor 13 is arranged to monitor the tail regions 10*a*, 10*b* of the flames 1*a*, 1*b*. The second sensor 13 can advantageously be employed to monitor infrared radiation originating from the tail regions 10*a*, 10*b* of the flames 1*a*, 1*b*. In some embodiments, the second sensor 13 offers sufficient temporal resolution. The second sensor 13 then affords monitoring of temporal oscillations in the intensity of the infrared radiation. The second sensor 13 may, in particular, afford monitoring of temporal oscillations in intensity as the flame 1*b* grows larger.

Figure 3:
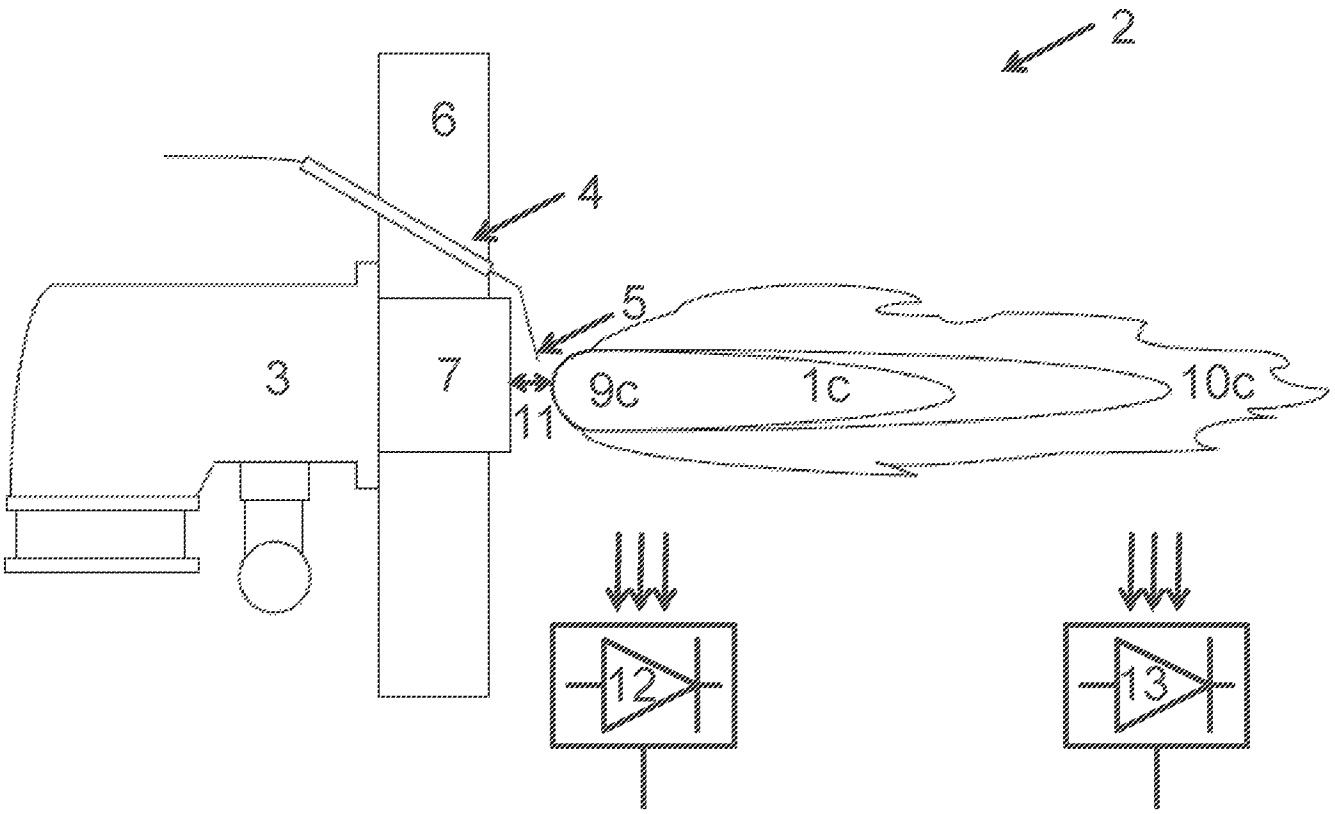
FIG. 3 illustrates flame lift-off inside a combustion appliance.

Now turning to FIG. 3, a flame lift-off is illustrated. Flame lift-off may, by way of non-limiting example, occur as the rate of combustion is being reduced from an elevated rate of combustion. A flame lift-off may result in the flame being blown off. A flame lift-off as shown on FIG. 3 may also result in a safety condition and/or in a lockout of the appliance. As can be seen in FIG. 3, the flame 1*c* has migrated away from the exit of the nozzle 7 and/or from the injection orifice of the nozzle 7 into the burner chamber 2. The root region 9*c* of the flame 1*c* is now separated from the injection orifice by a lift-off length 11. The lift-off length 11 is the distance between the two closest points on the injection orifice and on the outer surface of the root region 9*c*. Also, the ionization electrode 4 is no longer covered by the root region 9*c* of the flame 1*c*. In particular, the tip 5 of the ionization electrode 4 is no longer covered by the root region 9*c* of the flame 1*c*.

In some embodiments, the first sensor 12 is arranged to monitor the root region 9*c* of the flame 1*c*. The first sensor 12 can be employed to monitor ultraviolet radiation originating from the root region 9*c* of the flame 1*c*. The first sensor 12 may offer sufficient temporal resolution. The first sensor 12 then affords monitoring a drop ultraviolet radiation caused by a flame lift-off.

Figure 4:
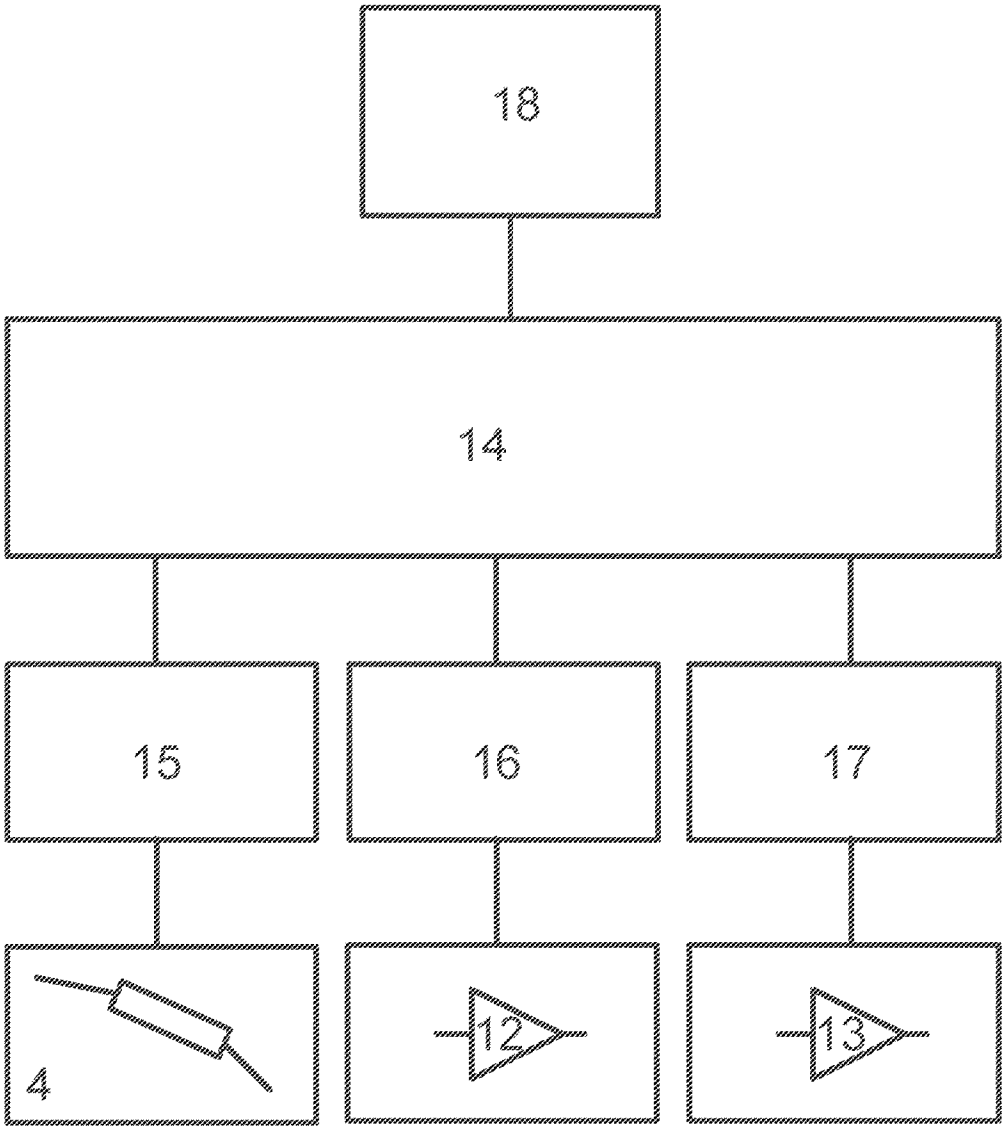
FIG. 4 illustrates processing signals from the various sensors associated with the combustion appliance.

Now referring to FIG. 4, a signal processing circuit having a processor 14 such as a microcontroller or a microprocessor is shown. The processor 14 connects to the ionization electrode 4 via a signal conditioning unit 15 for the ionization signal. The signal conditioning unit 15 may, by way of non-limiting example, amplify, rectify and/or filter a signal obtained from the ionization electrode 4. In some embodiments, the signal conditioning unit 15 obtains analog signals from the ionization electrode 4 and transmits digital signals to the processor 14. The signal conditioning unit 15 may connect to the processor 14 via a communication bus such as a serial bus. The signal conditioning unit 15 may communicate with the processor 14 using a communication bus protocol such as a digital protocol.

In some embodiments, the signal conditioning unit 15 obtains analog signals from the ionization electrode 4 and transmits analog signals to the processor 14. The analog signals transmitted to the processor 14 can be electric currents in the range between 0 mA and 20 mA, in particular between 4 mA and 20 mA. The analog signals transmitted to the processor 14 can also be electric voltages in the range between 0 V and 5 V, in particular between 0 V and 3.3 V or between 0 V and 3 V or between 0 V and 2 V. In some embodiments, the processor 14 provides an analog-to-digital converter with sufficient resolution and/or bandwidth to read signals from the signal conditioning unit 15. In some embodiments, the analog-to-digital converter and the processor 14 are arranged on the same system-on-a-chip.

The processor 14 connects to the first sensor 12 via a signal conditioning unit 16 for the first sensor 12. The signal conditioning unit 16 may, by way of non-limiting example, amplify, rectify and/or filter a signal obtained from the first sensor 12. Amplification of the signal obtained from the first sensor 12 can involve a low noise amplifier and/or an ultralow noise amplifier. In some embodiments, the signal conditioning unit 16 obtains analog signals from the first sensor 12 and transmits digital signals to the processor 14. The signal conditioning unit 16 may connect to the processor 14 via a communication bus such as a serial bus. The same communication bus may afford communication between the processor 14 and the signal conditioning units 15 and 16. The signal conditioning unit 16 preferably communicates with the processor 14 using a communication bus protocol such as a digital protocol.

In some embodiments, the signal conditioning unit 16 obtains analog signals from the first sensor 12 and transmits analog signals to the processor 14. The analog signals transmitted to the processor 14 can be electric currents in the range between 0 mA and 20 mA, in particular between 4 mA and 20 mA. The analog signals transmitted to the processor 14 can also be electric voltages in the range between 0 V and 5 V, in particular between 0 V and 3.3 V or between 0 V and 3 V or between 0 V and 2 V. It is envisaged that the processor 14 provides an analog-to-digital converter with sufficient resolution and/or bandwidth to read signals from the signal conditioning unit 16. The same analog-to-digital converter can be employed to read signals from the signal conditioning units 15 and 16. In some embodiments, the analog-to-digital converter and the processor 14 are arranged on the same system-on-a-chip.

The processor 14 connects to the second sensor 13 via a signal conditioning unit 17 for the second sensor 13. The signal conditioning unit 17 may, by way of non-limiting example, amplify, rectify and/or filter a signal obtained from the second sensor 13. Amplification of the signal obtained from the second sensor 13 may involve a low noise amplifier and/or an ultralow noise amplifier. In some embodiments, the signal conditioning unit 17 obtains analog signals from the second sensor 13 and transmits digital signals to the processor 14. The signal conditioning unit 17 may connect to the processor 14 via a communication bus such as a serial bus. The same communication bus may afford communication between the processor 14 and the signal conditioning units 15, 16, and 17. The signal conditioning unit 17 may communicate with the processor 14 using a communication bus protocol such as a digital protocol.

In some embodiments, the signal conditioning unit 17 obtains analog signals from the second sensor 13 and transmits analog signals to the processor 14. The analog signals transmitted to the processor 14 can be electric currents in the range between 0 mA and 20 mA, in particular between 4 mA and 20 mA. The analog signals transmitted to the processor 14 can also be electric voltages in the range between 0 V and 5 V, in particular between 0 V and 3.3 V or between 0 V and 3 V or between 0 V and 2 V. It is envisaged that the processor 14 provides an analog-to-digital converter with sufficient resolution and/or bandwidth to read signals from the signal conditioning unit 17. The same analog-to-digital converter can be employed to read signals from the signal conditioning units 15, 16, and 17. In some embodiments, the analog-to-digital converter and the processor 14 are arranged on the same system-on-a-chip.

A drop in the ionization current recorded and/or sampled via the ionization electrode 4 may indicate flame lift-off. Likewise, a drop in ultraviolet radiation recorded and/or sampled via the first sensor 12 may indicate flame lift-off. The processor 14 may produce a safety signal, if one of the signals recorded and/or sampled via the ionization electrode 4 or via the first sensor 12 indicates flame lift-off. The processor 14 may also produce a safety signal, if the two signals recorded and/or sampled via the ionization electrode 4 or via the first sensor 12 both indicate flame lift-off. The processor 14 can also process a signal obtained from the second sensor 13 before issuing a safety signal.

The safety signal may result in a lockout of the combustion appliance. To that end, a shutoff valve in the combustion appliance can be closed. An indication of a fault condition may also be displayed in response to a safety signal. To that end, the processor 14 connects to a display 18. An indication of a fault condition may also be forwarded to a cloud computer. To that end, the processor 14 connects to a cloud computer via a network such as the internet. The cloud computer is typically installed in a location that is remote from the combustion appliance.

As described in detail herein, the present disclosure teaches a control system comprising an ionization electrode (4), a first flame sensor (12), a first signal conditioning circuit (15) in operative communication with the ionization electrode (4), a second signal conditioning circuit (16) in operative communication with the first flame sensor (12), an output unit (18), a processor (14) in operative communication with the first and with the second signal conditioning circuits (15, 16) and with the output unit (18), the processor (14) being configured to: receive first and second ionization signals indicative of ionization currents via the first signal conditioning circuit (15) from the ionization electrode (4), the second ionization signal being received after the first ionization signal; receive first and second flame signals indicative of radiation(s) originating from a flame (1*a*-1*c*) via the second signal conditioning circuit (16) from the first flame sensor (12), the second flame signal being received after the first flame signal; produce a derived ionization signal as a function of the first and the second ionization signals; produce a derived flame signal as a function of the first and the second flame signals; determine if a flame lift-off condition exists based on the derived ionization signal and based on the derived flame signal; and if a flame lift-off condition exists, produce a safety signal and transmit the safety signal to the output unit (18).

The first flame sensor (12) may be different from the ionization electrode (4). The control system may comprise a control system for a burner and/or for a combustion appliance. In some embodiments, the safety signal is a lift-off signal. In some embodiments, the derived ionization signal is a differential ionization signal. In some embodiments, the derived flame signal is a differential flame signal.

In some embodiments, the processor (14) is, in the event of and/or in case of a flame lift-off condition, configured to produce a safety signal and transmit the safety signal to the output unit (18).

As an example, some embodiments include a processor (14) configured to: receive from the ionization electrode (4) via the first signal conditioning circuit (15) at a first point in time a first ionization signal indicative of an ionization current; and receive from the ionization electrode (4) via the first signal conditioning circuit (15) at a second point in time a second ionization signal indicative of an ionization current.

In some embodiments, the processor (14) is configured to: receive from the first flame sensor (12) via the second signal conditioning circuit (16) at a third point in time a first flame signal indicative of a radiation originating from a flame (1*a*-1*c*); and receive from the first flame sensor (12) via the second signal conditioning circuit (16) at a fourth point in time a second flame signal indicative of a radiation originating from a flame (1*a*-1*c*).

In some embodiments, the first point in time coincides with the third point in time and the second point in time coincides with the fourth point in time. In some embodiments, the first point in time does not coincide with the third point in time and the second point in time does not coincide with the fourth point in time.

In some embodiments, the first flame sensor (12) is different from the ionization electrode (4).

In some embodiments, the control system comprises a control system for a combustion appliance. In some embodiments, the control system comprises a control system for a combustion appliance such as a gas burner or an oil burner.

In some embodiments, the processor (14) is configured to: produce the derived ionization signal as a difference between (an amplitude of) the first ionization signal and (an amplitude of) the second ionization signal; and produce the derived flame signal as a difference between (an amplitude of) the first flame signal and (an amplitude of) the second flame signal.

In some embodiments, the processor (14) is configured to: produce the derived ionization signal as an absolute value of a difference between (an amplitude of) the first ionization signal and (an amplitude of) the second ionization signal; and produce the derived flame signal as an absolute value of a difference between (an amplitude of) the first flame signal and (an amplitude of) the second flame signal.

In some embodiments, the processor (14) is configured to: compare the derived ionization signal to a first predetermined threshold to produce a first indication of flame lift-off; compare the derived flame signal to a second predetermined threshold to produce a second indication of flame lift-off; and determine if a flame lift-off condition exists as a function of the first and the second indications of flame lift-off.

In some embodiments, the processor (14) is configured to determine that a flame lift-off condition exists if the first indication of flame lift-off exceeds the first predetermined threshold, or if the second indication of flame lift-off exceeds the second predetermined threshold.

In some embodiments, the processor (14) is configured to determine that a flame lift-off condition exists if the first indication of flame lift-off exceeds the first predetermined threshold, and if the second indication of flame lift-off exceeds the second predetermined threshold.

In some embodiments, the processor (14) is configured to: compare the second ionization signal to the first ionization signal; compare the second flame signal to the first flame signal; and determine that a flame lift-off condition exists if the second ionization signal is less than half the first ionization signal, or if the second flame signal is less than ninety percent of the first flame signal.

In some embodiments, the processor (14) is configured to determine that a flame lift-off condition exists if (an amplitude of) the second ionization signal is less than half (an amplitude of) the first ionization signal, or if (an amplitude of) the second flame signal is less than ninety percent of (an amplitude of) the first flame signal.

In some embodiments, the processor (14) is configured to determine that a flame lift-off condition exists if (an amplitude of) the second ionization signal is less than twenty percent of (an amplitude of) the first ionization signal, or if (an amplitude of) the second flame signal is less than fifty percent of (an amplitude of) the first flame signal.

In some embodiments, the processor (14) is configured to determine that a flame lift-off condition exists if (an amplitude of) the second ionization signal is less than ten percent of (an amplitude of) the first ionization signal, or if (an amplitude of) the second flame signal is less than twenty percent of the (an amplitude of) first flame signal.

An or-type logical conjunction between differences in ionization signals and differences in flame signals entails a prompt response to a fault condition.

In some embodiments, the processor (14) is configured to: compare the second ionization signal to the first ionization signal; compare the second flame signal to the first flame signal; and determine that a flame lift-off condition exists if the second ionization signal is less than half the first ionization signal, and if the second flame signal is less than ninety percent of the first flame signal.

In some embodiments, the processor (14) is configured to determine that a flame lift-off condition exists if (an amplitude of) the second ionization signal is less than half (an amplitude of) the first ionization signal, and if (an amplitude of) the second flame signal is less than ninety percent of (an amplitude of) the first flame signal.

In some embodiments, the processor (14) is configured to determine that a flame lift-off condition exists if (an amplitude of) the second ionization signal is less than twenty percent of (an amplitude of) the first ionization signal, and if (an amplitude of) the second flame signal is less than fifty percent of (an amplitude of) the first flame signal.

In some embodiments, the processor (14) is configured to determine that a flame lift-off condition exists if (an amplitude of) the second ionization signal is less than ten percent of (an amplitude of) the first ionization signal, and if (an amplitude of) the second flame signal is less than twenty percent of (an amplitude of) the first flame signal.

Low percentages of second signals compared to high percentages first signals reduce likelihoods of false alarms. An and-type logical conjunction between differences in ionization signals and differences in flame signals reduces likelihoods of false alarms.

In some embodiments, the output unit (18) comprises a shut-off valve; and wherein the shut-off valve (18) is configured to close and/or is configured to initiate shut-off in response to the output unit (18) receiving the safety signal. In some embodiments, the output unit (18) is a shut-off valve.

In some embodiments, the output unit (18) comprises a display; wherein the processor (14), in case of a flame lift-off condition, is configured to produce an alarm message and to transmit the alarm message to the display (18); and wherein the display (18) is configured to show the received alarm message.

In some embodiments, a control system includes a processor (14) configured to produce an alarm message and to transmit the alarm message to the display (18), if an emergency condition exists.

In some embodiments, the output unit (18) is a display. The control system may also comprise a graphics adapter in operative communication with the display (18) and in operative communication with the processor (14). The processor (14), in the event of and/or in case of a flame lift-off condition, is configured to transmit the alarm message to the graphics adapter. The graphics adapter is, in response to receiving the alarm message, configured to produce a graphics signal indicative of the alarm message and to transmit the graphics signal to the display (18). The display (18) is configured to display the alarm message in response to receiving the graphics signal.

In some embodiments, the second ionization signal is received less than four hundred milliseconds after the first ionization signal; and the second flame signal is received less than four hundred milliseconds after the first flame signal. The second ionization signal may be received less than one thousand or less than four hundred milliseconds, less than two hundred milliseconds, or even less than fifty milliseconds after the first ionization signal.

The second flame signal may be received less than one thousand or less than four hundred milliseconds, less than two hundred milliseconds, or even less than fifty milliseconds after the first flame signal. Short delays entail prompt responses to a fault condition.

In some embodiments, the delays between the second ionization signal and the first ionization signal depend on power frequency. In some embodiments, the delays between the second flame signal and the first flame signal depend on power frequency. That is, a power frequency such as 60 Hz results in shorter delays compared to a power frequency such as 50 Hz. Likewise, a power frequency such as 400 Hz results in shorter delays compared to a power frequency of 60 Hz.

In some embodiments, the control system additionally comprises a second flame sensor (13), a third signal conditioning circuit (17) in operative communication with the second flame sensor (13), the processor (14) being in operative communication with the third signal conditioning circuit (17), the processor (14) being configured to: receive from the second flame sensor (13) via the third signal conditioning circuit (17) a third flame signal at a first point in time and a fourth flame signal at a second point in time, the third and the fourth flame signals being indicative of radiation(s) originating from a flame (1*a*-1*c*), the fourth flame signal being received after the third flame signal; determine an oscillation frequency by sampling the third flame signal at the first point in time and the fourth flame signal at the second point in time; and determine if a flame lift-off condition exists based on the derived ionization signal and based on the derived flame signal and based on the oscillation frequency.

In some embodiments, the processor (14) is configured to determine that a flame lift-off condition exists if the oscillation frequency is above a (predetermined) frequency threshold. In some embodiments, the processor (14) is configured to determine that a flame lift-off condition exists if the oscillation frequency is below a (predetermined) frequency threshold.

The second flame sensor (13) may be different from the first flame sensor (12) and from the ionization electrode (4).

In some embodiments, an oscillation frequency is determined as a function of the third flame signal at/and the first point in time and as a function of the fourth flame signal at/and the second point in time. In so doing, the third flame signal at the first point in time and the fourth flame signal at the second point in time are sampled.

The fourth flame signal may be received less than one hundred milliseconds, less than fifty milliseconds, or even less than twenty milliseconds after the third flame signal. Short delays entail prompt responses to a fault condition.

In some embodiments, the first flame sensor (12) comprises an ultraviolet light sensor, the first flame sensor (12) being configured to produce the first flame signal in response to receiving a first amount of ultraviolet light and being configured to produce the second flame signal in response to receiving a second amount of ultraviolet light; and ultraviolet light has an optical wavelength below four hundred nanometers.

In some embodiments, the first flame sensor (12) has a spectral sensitivity $\lambda_{10\%}$ at an optical wavelength below four hundred nanometers. In some embodiments, the first flame sensor (12) comprises an ultraviolet light sensor. The first flame sensor (12) may produce an (electric) signal indicative of an amount of ultraviolet radiation originating from a flame (1*a*-1*c*) and incident on the first flame sensor (12).

In some embodiments, the second flame sensor (13) comprises an infrared light sensor, the second flame sensor (13) being configured to produce the third flame signal in response to receiving a first amount of infrared light and being configured to produce the fourth flame signal in response to receiving a second amount of infrared light; and infrared light has an optical wavelength above eight hundred nanometers.

The second flame sensor (13) may have a spectral sensitivity $\lambda_{10\%}$ at an optical wavelength above eight hundred nanometers. In some embodiments, the second flame sensor (13) comprises an infrared light sensor. The second flame sensor (13) ideally produces an (electric) signal indicative of an amount of infrared radiation originating from a flame (1*a*-1*c*) and incident on the second flame sensor (13).

Some embodiments include a combustion appliance comprising a feed conduit (3), a combustion chamber (2) and a nozzle (7), the nozzle (7) affording fluid communication between the feed conduit (3) and the combustion chamber (2), the nozzle (7) having an injection orifice pointing toward the combustion chamber (2), the combustion appliance further comprising a control system according to the present disclosure, wherein the ionization electrode (4) has a far end and has a tip (5) disposed at the far end of the ionization electrode (4); wherein the tip (5) is arranged inside the combustion chamber (2); and wherein a smallest distance among all distances between the tip (5) and the injection orifice is less than twenty millimeters.

In some embodiments, the nozzle (7) enables fluid communication between the feed conduit (3) and the combustion chamber (2). In some embodiments, the smallest distance among all distances between the tip (5) and (any point on) the injection orifice is less than fifty millimeters, less than twenty millimeters, or even less than ten millimeters.

In some embodiments, the aforementioned control system is employed in a medical device.

Any steps of a method taught in the present disclosure may be embodied in hardware, in a software module executed by a processor, in a software module being executed using operating-system-level virtualization, in a cloud computing arrangement, or in a combination thereof. The software may include a firmware, a hardware driver run in the operating system, or an application program. Thus, the disclosure also relates to a computer program product for performing the operations presented herein. If implemented in software, the functions described may be stored as one or more instructions on a computer-readable medium. Some examples of storage media that may be used include random access memory (RAM), read only memory (ROM), flash memory, EPROM memory, EEPROM memory, registers, a hard disk, a removable disk, other optical disks, or any available media that can be accessed by a computer or any other IT equipment and appliance.

It should be understood that the foregoing relates only to certain embodiments of the disclosure and that numerous changes may be made therein without departing from the scope of the disclosure as defined by the following claims. It should also be understood that the disclosure is not restricted to the illustrated embodiments and that various modifications can be made within the scope of the following claims.

REFERENCE NUMERALS

1*a*, 1*b*, 1*c* flames
2 combustion chamber
3 feed conduit
4 ionization electrode
5 tip
6 frame
7 nozzle
8 flange
9*a*, 9*b*, 9*c* root region
10*a*, 10*b*, 10*c* tail region
11 lift-off length
12 first light sensor
13 second light sensor
14 processor
15 signal conditioning unit
16 signal conditioning unit
17 signal conditioning unit
18 output unit

The invention claimed is:

1. A control system comprising:
an ionization electrode;
a first flame sensor;
a first signal conditioning circuit in communication with the ionization electrode;
a second signal conditioning circuit in communication with the first flame sensor;
an output unit; and
a processor in communication with the first signal conditioning circuit and with the second signal conditioning circuits and with the output unit; the processor configured to:
receive a first ionization signal and a second ionization signal indicative of ionization currents via the first signal conditioning circuit from the ionization electrode, the second ionization signal received after the first ionization signal;
receive a first flame signal and a second flame signal indicative of radiations originating from a flame via the second signal conditioning circuit from the first flame sensor, the second flame signal being received after the first flame signal;
produce a derived ionization signal as a function of the first and the second ionization signals;
produce a derived flame signal as a function of the first and the second flame signals;
determine if a flame lift-off condition exists based on the derived ionization signal and based on the derived flame signal; and
if a flame lift-off condition exists, produce a safety signal and transmit the safety signal to the output unit.

2. The control system according to claim 1, wherein the processor is further configured to:
produce the derived ionization signal as a difference between the first ionization signal and the second ionization signal; and
produce the derived flame signal as a difference between the first flame signal and the second flame signal.

3. The control system according to claim 1, wherein the processor is further configured to:
produce the derived ionization signal as an absolute value of a difference between the first ionization signal and the second ionization signal; and
produce the derived flame signal as an absolute value of a difference between the first flame signal and the second flame signal.

4. The control system according to claim 1, wherein the processor is further configured to:
compare the derived ionization signal to a first predetermined threshold to produce a first indication of flame lift-off;
compare the derived flame signal to a second predetermined threshold to produce a second indication of flame lift-off; and determine if a flame lift-off condition exists as a function of the first and the second indications of flame lift-off.

5. The control system according to claim 4, wherein the processor is further configured to determine that a flame lift-off condition exists: if the first indication of flame lift-off exceeds the first predetermined threshold, or if the second indication of flame lift-off exceeds the second predetermined threshold.

6. The control system according to claim 4, wherein the processor is further configured to determine that a flame lift-off condition exists: if the first indication of flame lift-off exceeds the first predetermined threshold, and if the second indication of flame lift-off exceeds the second predetermined threshold.

7. The control system according to claim 1, wherein the processor is further configured to:

compare the second ionization signal to the first ionization signal;

compare the second flame signal to the first flame signal; and determine that a flame lift-off condition exists if the second ionization signal is less than half the first ionization signal, or if the second flame signal is less than ninety percent of the first flame signal.

8. The control system according to claim 1, wherein the processor is further configured to:

compare the second ionization signal to the first ionization signal;

compare the second flame signal to the first flame signal; and determine that a flame lift-off condition exists if the second ionization signal is less than half the first ionization signal, and if the second flame signal is less than ninety percent of the first flame signal.

9. The control system according to claim 1, wherein the output unit comprises a shut-off valve configured to close in response to the output unit receiving the safety signal.

10. The control system according to claim 1, wherein:

the output unit comprises a display;

the processor, in case of a flame lift-off condition, is configured to produce an alarm message and to transmit the alarm message to the display; and the display is configured to show the received alarm message.

11. The control system according to claim 1, wherein:

the second ionization signal is received less than one thousand milliseconds after the first ionization signal; and the second flame signal is received less than one thousand milliseconds after the first flame signal.

12. The control system according to claim 1, further comprising:

a second flame sensor;

a third signal conditioning circuit in communication with the second flame sensor and the processor;

the processor further configured to:

receive from the second flame sensor via the third signal conditioning circuit a third flame signal at a first point in time and a fourth flame signal at a second point in time, the third and the fourth flame signals being indicative of radiations originating from a flame, the fourth flame signal being received after the third flame signal;

determine an oscillation frequency by sampling the third flame signal at the first point in time and the fourth flame signal at the second point in time; and determine if a flame lift-off condition exists based on the derived ionization signal and based on the derived flame signal and based on the oscillation frequency.

13. The control system according to claim 12, wherein:

the first flame sensor comprises an ultraviolet light sensor configured to produce the first flame signal in response to receiving a first amount of ultraviolet light and being configured to produce the second flame signal in response to receiving a second amount of ultraviolet light; and ultraviolet light has an optical wavelength below four hundred nanometers.

14. The control system according to claim 12, wherein:

the second flame sensor comprises an infrared light sensor configured to produce the third flame signal in response to receiving a first amount of infrared light and being configured to produce the fourth flame signal in response to receiving a second amount of infrared light; and infrared light has an optical wavelength above eight hundred nanometers.

15. A method for alerting a flame lift-off condition, the method comprising:

receiving a first ionization signal and a second ionization signal indicative of ionization currents via a first signal conditioning circuit from an ionization electrode, the second ionization signal received after the first ionization signal;

receiving a first flame signal and a second flame signal indicative of radiations originating from a flame via a second signal conditioning circuit from a first flame sensor, the second flame signal being received after the first flame signal;

producing a derived ionization signal as a function of the first and the second ionization signals;

producing a derived flame signal as a function of the first and the second flame signals;

determining if a flame lift-off condition exists based on the derived ionization signal and based on the derived flame signal; and if a flame lift-off condition exists, producing a safety signal and transmitting the safety signal to an output unit.

* * * * *